US011161580B1

(12) United States Patent
Sanders

(10) Patent No.: US 11,161,580 B1
(45) Date of Patent: Nov. 2, 2021

(54) ROLLER ASSISTED LOW FRICTION REEFING GROMMET

(71) Applicant: Henry Sanders, Hilton Head Island, SC (US)

(72) Inventor: Henry Sanders, Hilton Head Island, SC (US)

( * ) Notice: Subject to any disclaimer, the term of this patent is extended or adjusted under 35 U.S.C. 154(b) by 0 days.

(21) Appl. No.: 16/884,101

(22) Filed: May 27, 2020

(51) Int. Cl.
*B63H 9/10* (2006.01)

(52) U.S. Cl.
CPC ..... *B63H 9/1021* (2013.01); *B63H 2009/105* (2013.01)

(58) Field of Classification Search
CPC ... A43C 3/02; F16H 2055/363; B63H 9/1021; B63H 2009/105
See application file for complete search history.

(56) References Cited

U.S. PATENT DOCUMENTS 572,033 A 11/1896 See
724,716 A 4/1903 Kuehlhorn
908,704 A 1/1909 Sprinkle
1,328,333 A 1/1920 Mann
1,527,023 A 2/1925 Bowden
3,800,729 A 4/1974 Keeler
4,633,548 A * 1/1987 Siskind ..... A43C 1/00 24/687
4,664,574 A 5/1987 Kasai
5,495,995 A 3/1996 Dominique et al.
2015/0305443 A1* 10/2015 Kathpalia ..... A43C 5/00 24/68 SK

FOREIGN PATENT DOCUMENTS

GB 959937 A * 6/1964 ..... B63B 21/10

* cited by examiner

*Primary Examiner* — Andrew Polay
(74) *Attorney, Agent, or Firm* — B. Craig Killough; Hellman & Yates, PA

(57) ABSTRACT

A roller assisted low friction reefing grommet that facilitates movement of a reefing line through the grommet. The roller assisted low friction reefing grommet includes a grommet ring having a roller therein that reduces friction of the line traveling through the grommet. A line channeling guide is formed within the interior of the grommet ring by a low friction material positioned on either side of the grommet, with a channel formed by the line channeling guide and the roller for receiving and guiding the reefing line.

13 Claims, 2 Drawing Sheets

ROLLER ASSISTED LOW FRICTION REEFING GROMMET

BACKGROUND OF THE INVENTION

The area of a sail may be reduced by reefing. The sail is folded or rolled on one edge of the sail to reduce the area of the sail. Reefing may be used to improve performance of the sailing vessel in strong wind, and to improve safety in the event of high winds due to rough weather. Reefing may improve vessel stability in some weather situations.

Sails, such as mainsails, frequently have attachment points that allow the sail area to be reduced by attaching lines to the attachment points. Grommets are commonly inserted into voids of the mainsail. Reefing lines are run through the grommets in the mainsail and tied along the boom to reduce the sail area.

Frequently, it is advantageous to rapidly reef the sail due to unexpected or unanticipated bad weather. It is desirable to have a grommet that facilitates movement of the reefing line through the grommets. The grommets that are used in the sail are typically metal rings placed through the sail. The metal rings do not reduce friction or facilitate the line traveling through the grommet.

SUMMARY OF THE INVENTION

The present invention is a roller assisted low friction reefing grommet that facilitates movement of the reefing line through the grommet. The roller assisted low friction reefing grommet includes a grommet ring having a roller therein that reduces friction of the line traveling through the grommet. A line channeling guide is formed within the interior of the grommet ring by a low friction material positioned on either side of the grommet, with the channel formed by the line channeling guide and the roller. The combination of the roller and the low friction line channeling guide facilitate movement of the reefing line through the channel of the grommet, and reduce the likelihood of the reefing line getting snagged or caught within the grommet.

BRIEF DRAWING DESCRIPTION

DESCRIPTION OF PREFERRED EMBODIMENTS

Figure 1:
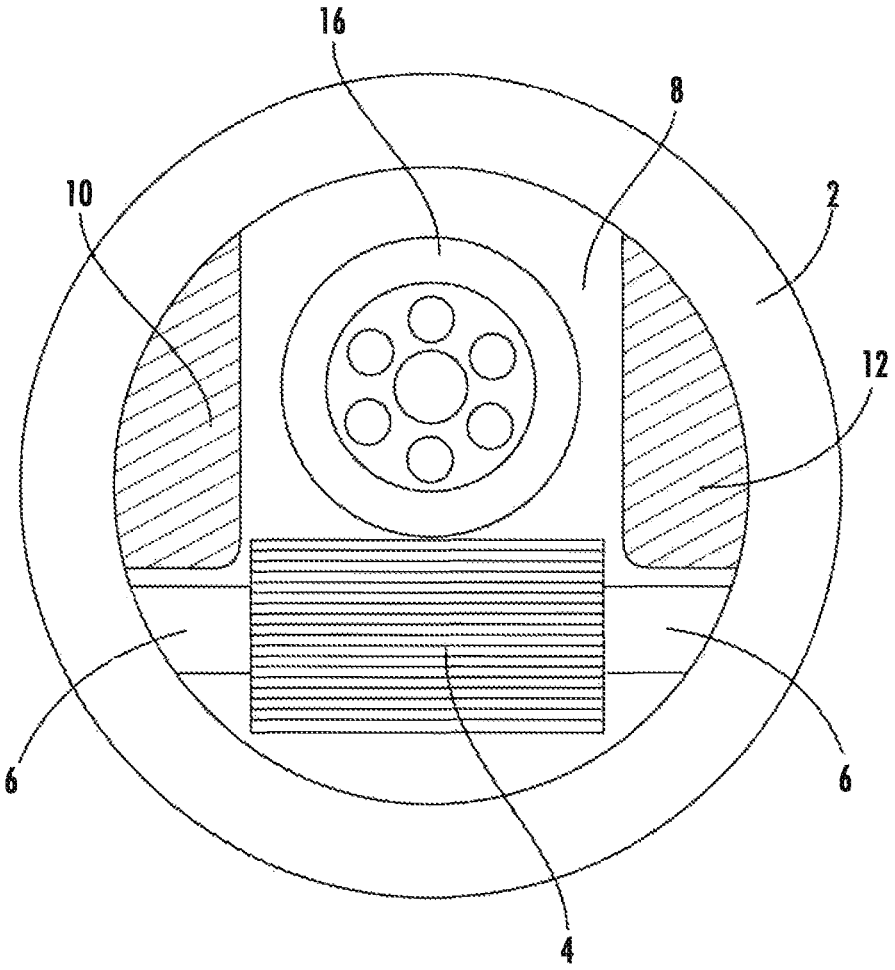
FIG. 1 is an elevation of the roller assisted low friction reefing grommet according to an embodiment of the invention.

Referring to FIG. 1, the roller assisted low friction reefing grommet according to an embodiment of the invention is shown. A grommet ring 2 has a roller 4 positioned inside the grommet ring. The roller rotates about a shaft and bearing 6. The shaft is fixed to the interior of the grommet ring at each end of the shaft. The grommet ring may be circular.

A line channeling guide has a first side 10 and a second side 12. The first side of the line channeling guide is opposite the second side of the channel guide. A channel 8 is formed between the first side of the line channeling guide and the second side of the line channeling guide, and the roller 4. As shown, and in a preferred embodiment, the roller is positioned between the first side of the line channeling guide and the second side of the line channeling guide and extends into the channel formed between the first side 10 and the second side 12. In one embodiment, the channel is formed by the first side of the line channeling guide, the second side of the line channeling guide, the roller and an upper portion of the interior of the grommet ring.

The line channeling guide 10,12 is formed of low friction material. The low friction material may be a plastic. The low friction material may comprise, for example, polytetrafluoroethylene, polyethylene, polyimide, polyetheretherketone, polyphenylensulfide, nylon, polyoxymethylene, and polyester, or a combination thereof.

Figure 2:
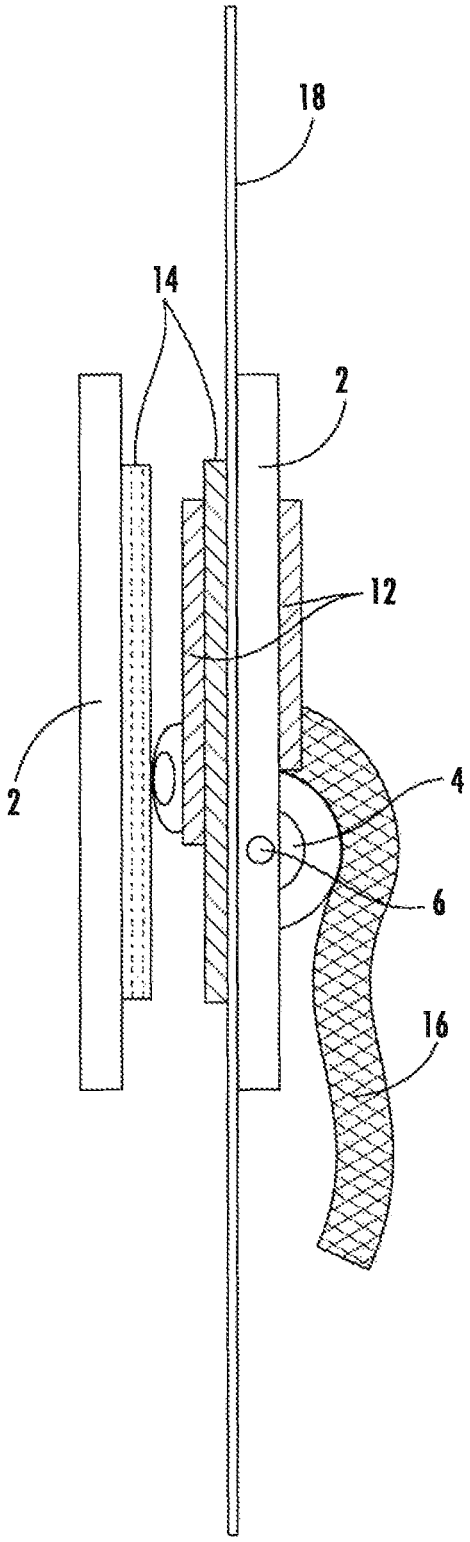
FIG. 2 is a side elevation of the roller assisted low friction reefing grommet, with the grommet ring in an exploded view.

FIG. 2 shows the roller assisted low friction reefing grommet as attached to a sail according to an embodiment of the invention. The grommet ring 2 is formed in two parts. One part of the grommet ring is constructed and arranged to attach to one side of a sail 18 and the opposite side of the grommet ring is attached to the opposite side of the sail. As shown in the embodiment of FIG. 2, one side of the grommet ring has threads 14 that extend through the sail into an opposite side of the sail. These threads engage corresponding threads 14 on the opposite side of the grommet ring. Accordingly, the grommet ring is attached to the sail by placing one side of the grommet ring through a hole or void formed in the sail and the opposite side of the grommet is threaded onto the other side of the grommet ring from the opposite side of the sail. This feature permits the grommet to be moved from sail to sail if the owner obtains new sails.

In use, a reefing line 16 is pulled through the channel formed in the grommet ring 2 and over the roller 4 and through to the other side of the grommet ring. The roller and the line channeling guides 10,12 guide the reefing line through the grommet ring, while the roller and the line channeling guides reduce friction as the reefing line passes through the grommet. Pulling the reefing line through the grommet of the invention is expedited by the reduced friction provided.

What is claimed:

1. A roller assisted low friction reefing grommet for a sailboat sail, comprising:

a grommet ring constructed and arranged for positioning within a sail for a sailboat;

a roller positioned within an interior of the grommet ring, and a line channeling guide extending into the interior of the grommet ring, wherein a channel for receiving a line is formed in the interior of the grommet ring by the line channeling guide and the roller, and the channel is bordered by a first side of the line channeling guide, a second side of the line channeling guide that is opposite the first side of the line channeling guide, and the roller, and wherein the channel is constructed and arranged to receive a line within the channel to provide contact of the line with the first side of the line channeling guide and the roller.

2. A roller assisted low friction reefing grommet for a sailboat sail as described in claim 1, wherein the first side of the line channeling guide and the second side of the line channeling guide are formed of plastic and the grommet ring is formed of metal.

3. A roller assisted low friction reefing grommet for a sailboat sail as described in claim 1, wherein the first side of the line channeling guide and the second side of the line channeling guide are formed of a material chosen from a group consisting of polytetrafluoroethylene, polyethylene, polyimide, polyetheretherketone, polyphenylensulfide, nylon, polyoxymethylene, polyester, or a combination thereof.

4. A roller assisted low friction reefing grommet for a sailboat sail as described in claim 1, wherein the grommet ring comprises a first side constructed and arranged to contact a first side of a sail, and the grommet ring comprises a second side constructed and arranged to contact a second side of the sail, wherein the first side of the grommet ring comprises threads that are constructed and arranged to extend through the sail, and the second side of the grommet ring comprises threads that engage the threads of the first side of the grommet ring.

5. A roller assisted low friction reefing grommet for a sailboat sail as described in claim 1, wherein the roller rotates about a roller shaft, and the roller shaft is mounted to the grommet ring.

6. A roller assisted low friction reefing grommet for a sailboat sail as described in claim 1, wherein the roller is positioned between the first side of the line channeling guide and the second side of the line channeling guide.

7. A roller assisted low friction reefing grommet for a sailboat sail as described in claim 1, wherein the roller is positioned between the first side of the line channeling guide and the second side of the line channeling guide and into a space that is present between the first side of the line channeling guide and the second side of the line channeling guide.

8. A roller assisted low friction reefing grommet for a sailboat sail, comprising:

a grommet ring, wherein the grommet ring comprises a first side constructed and arranged to contact a first side of a sail, and the grommet ring comprises a second side constructed and arranged to contact a second side of the sail, wherein the first side of the grommet ring comprises threads that are constructed and arranged to extend through the sail, and the second side of the grommet ring comprises threads that engage the threads of the first side of the grommet ring, and a roller positioned within an interior of the grommet ring, a line channeling guide positioned within the interior of the grommet ring, wherein the line channeling guide is constructed and arranged to receive a line therein and the line channeling guide comprises a first side extending from a first side of the grommet, a second side extending from a second side of the grommet and the roller.

9. A roller assisted low friction reefing grommet for a sailboat sail as described in claim 8, wherein the first side of the line channeling guide and the second side of the line channeling guide are formed of plastic and the grommet ring is formed of metal.

10. A roller assisted low friction reefing grommet for a sailboat sail as described in claim 8, wherein the first side of the line channeling guide and the second side of the line channeling guide are formed of a material chosen from a group consisting of polytetrafluoroethylene, polyethylene, polyimide, polyetheretherketone, polyphenylensulfide, nylon, polyoxymethylene, polyester, or a combination thereof.

11. A roller assisted low friction reefing grommet for a sailboat sail as described in claim 8, wherein the roller rotates about a roller shaft, and the roller shaft is mounted to the grommet ring.

12. A roller assisted low friction reefing grommet for a sailboat sail as described in claim 8, wherein the roller is positioned between the first side of the line channeling guide and the second side of the line channeling guide.

13. A roller assisted low friction reefing grommet for a sailboat sail as described in claim 8, wherein the roller is positioned between the first side of the line channeling guide and the second side of the line channeling guide and into a space that is present between the first side of the line channeling guide and the second side of the line channeling guide.

* * * * *